US008277247B2

(12) United States Patent
Paynter

(10) Patent No.: US 8,277,247 B2
(45) Date of Patent: Oct. 2, 2012

(54) SHIELDED GRIP RING FOR COAXIAL CONNECTOR

(75) Inventor: Jeffrey D. Paynter, St. Momence, IL (US)

(73) Assignee: Andrew LLC, Hickory, NC (US)

( * ) Notice: Subject to any disclaimer, the term of this patent is extended or adjusted under 35 U.S.C. 154(b) by 231 days.

(21) Appl. No.: 12/886,939

(22) Filed: Sep. 21, 2010

(65) Prior Publication Data

US 2011/0009000 A1 Jan. 13, 2011

Related U.S. Application Data

(63) Continuation-in-part of application No. 12/611,095, filed on Nov. 2, 2009, now Pat. No. 7,927,134, which is a continuation-in-part of application No. 12/264,932, filed on Nov. 5, 2008, now Pat. No. 7,806,724.

(51) Int. Cl.
*H01R 9/05* (2006.01)

(52) U.S. Cl. ..... 439/578

(58) Field of Classification Search ..... 439/578; 174/664

See application file for complete search history.

(56) References Cited

U.S. PATENT DOCUMENTS

| | | | | |
|---|---|---|---|---|
| 3,671,926 | A | 6/1972 | Nepovim | |
| 3,744,011 | A | 7/1973 | Blanchenot | |
| 3,757,279 | A | 9/1973 | Winston | |
| 3,761,870 | A | 9/1973 | Drezin et al. | |
| 3,802,654 | A | 4/1974 | Jenko et al. | |
| 4,824,400 | A | 4/1989 | Spinner | |
| 4,923,412 | A | 5/1990 | Morris | |
| 5,267,877 | A | 12/1993 | Scannelli et al. | |
| 5,322,454 | A | 6/1994 | Thommen | |
| 5,352,134 | A | 10/1994 | Jacobsen et al. | |
| 5,795,188 | A | 8/1998 | Harwath | |
| 5,944,556 | A | 8/1999 | Wlos et al. | |
| 5,967,852 | A | 10/1999 | Follingstad et al. | |
| 6,019,636 | A | 2/2000 | Langham | |
| 6,332,815 | B1 * | 12/2001 | Bruce | 439/862 |
| 6,335,488 | B1 | 1/2002 | Gretz | |
| 6,808,415 | B1 | 10/2004 | Montena | |
| 6,848,939 | B2 | 2/2005 | Stirling | |

(Continued)

FOREIGN PATENT DOCUMENTS

DE 9407225 5/1995

(Continued)

OTHER PUBLICATIONS

International Search Report, related application PCT/US2010/051773, issued Feb. 21, 2011 by European Patent Office, Netherlands.

(Continued)

*Primary Examiner* — Vanessa Girardi
(74) *Attorney, Agent, or Firm* — Babcock IP, PLLC

(57) ABSTRACT

A grip ring for a coaxial connector couples with a coaxial cable with a solid outer conductor. The c-shaped ring is provided with a gap between a first end and a second end. A shield portion extends from the first end and a slot portion dimensioned to receive the shield portion provided in the second end. The shield portion keys with the slot portion as a diameter of the grip ring is reduced. An inner diameter of the grip ring is provided with a grip surface. Further, the grip ring may be provided with a flange edge at the cable end projecting from the outer diameter.

19 Claims, 15 Drawing Sheets

U.S. PATENT DOCUMENTS

| | | | | |
|---|---|---|---|---|
| 7,011,546 | B2 | 3/2006 | Vaccaro | |
| 7,064,272 | B2 * | 6/2006 | Auray et al. | 174/659 |
| 7,156,696 | B1 | 1/2007 | Montena | |
| 7,249,969 | B2 | 7/2007 | Paynter | |
| 7,329,149 | B2 | 2/2008 | Montena | |
| 7,335,059 | B2 | 2/2008 | Vaccaro | |
| 7,588,460 | B2 | 9/2009 | Malloy et al. | |
| 2005/0164552 | A1 | 7/2005 | Wlos et al. | |
| 2006/0054343 | A1 | 3/2006 | Auray et al. | |
| 2009/0325420 | A1 | 12/2009 | Paynter | |
| 2010/0029132 | A1 | 2/2010 | Phillips, Jr. | |

FOREIGN PATENT DOCUMENTS

| | | |
|---|---|---|
| DE | 19944491 | 4/2001 |

OTHER PUBLICATIONS

International search report for counterpart application No. PCT/US2009/063315. Issued on Jun. 22, 1010.

International search report for counterpart application No. PCT/US2009/063320. Issued on Jun. 22, 1010.

* cited by examiner

SHIELDED GRIP RING FOR COAXIAL CONNECTOR

CROSS REFERENCE TO RELATED APPLICATIONS

This application is a continuation-in-part of commonly owned U.S. Utility patent application Ser. No. 12/611,095, titled "Insertion Coupling Coaxial Connector", filed Nov. 2, 2009 by Jeffrey Paynter and Al Cox, now U.S. Utility Pat. No. 7,927,134, hereby incorporated by reference in its entirety, which is a continuation-in-part of commonly owned U.S. Utility patent application Ser. No. 12/264,932, titled "Insertion Coupling Coaxial Connector", filed Nov. 5, 2008 by Jeffrey Paynter and Al Cox, now U.S. Utility Pat. No. 7,806,724, hereby incorporated by reference in its entirety.

BACKGROUND

1. Field of the Invention

This invention relates to electrical cable connectors. More particularly, the invention relates to an internal grip ring for a solid outer conductor insertion coupling type coaxial cable connector.

2. Description of Related Art

Coaxial cable connectors are used, for example, in communication systems requiring a high level of precision and reliability.

To create a secure mechanical and optimized electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body via a coupling nut. Representative of this technology is commonly owned U.S. Pat. No. 5,795,188 issued Aug. 18, 1998 to Harwath.

Machine threaded coupling surfaces between the metal body and the metal coupling nut of U.S. Pat. No. 5,795,188 and similarly configured prior coaxial connectors significantly increase manufacturing costs and installation time requirements. Another drawback is the requirement for connector disassembly, sliding the back body over the cable end and then performing a precision cable end flaring operation, which retains the cable within the connector body during threading. Further, care must be taken at the final threading procedure and/or the addition of connector element(s) to avoid damaging the flared end portion of the outer conductor as it is clamped between the body and the coupling nut to form a secure electrical connection between the outer conductor and the coaxial cable.

Alternative coaxial connector solutions, utilizing gripping/and or support elements about which the connector body is then radially crimped and/or axially compressed to secure an electromechanical interconnection between the outer conductor of the coaxial cable and the connector, are also known in the art. Crimped and/or compressed connections may be subject to varying quality depending upon the specific force level applied by the installer in each instance. Support surfaces added to prevent collapse of the outer conductor inserted within the inner diameter of the outer conductor, common in connectors for non-solid outer conductor coaxial cables, introduce an electrical performance degrading impedance discontinuity into the signal path. Further, crimping and/or compression becomes impractical with larger diameter coaxial cables, as the increased diameter, sidewall thickness and/or required travel of the corresponding connector/back body(s) increases the required force(s) beyond the levels deliverable by conventional crimp/compression hand tools.

Competition in the coaxial cable connector market has focused attention on improving electrical performance and minimization of overall costs, including materials costs, training requirements for installation personnel, reduction of dedicated installation tooling and the total number of required installation steps and/or operations.

Therefore, it is an object of the invention to provide a coaxial connector solution that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor analyzed available solid outer conductor coaxial connectors and recognized the drawbacks of threaded inter-body connection(s), manual flaring installation procedures and crimp/compression coaxial connector designs. Insertion coupling coaxial connectors, for example as disclosed in the inventor's commonly owned U.S. Utility patent application Ser. No. 12/264,932, titled "Insertion Coupling Coaxial Connector", filed Nov. 5, 2008, now U.S. Utility Pat. No. 7,806,724 and hereby incorporated by reference in its entirety, introduces several significant improvements to the coaxial connector arts, eliminating the need for manual flaring of the outer conductor and/or high torque threading of the coupling nut into the connector body during outer conductor end clamping connector to cable end interconnection. Similarly, several improvements to the insertion coupling coaxial connector are disclosed in the inventors commonly owned U.S. Utility patent application Ser. No. 12/611,095, titled "Insertion Coupling Coaxial Connector", filed Nov. 2, 2009, now U.S. Utility Pat. No. 7,927,134, hereby incorporated by reference in its entirety.

The inventor's electrical performance analysis of the prior insertion coupling coaxial connectors has recognized that in view of allowances made for diameter changes of outer conductor contacting elements of an insertion coupling connector during interconnection, an entirely circumferential connection may not be present around the outer conductor. Thereby, a significant level of RF leakage may occur through gap(s) in the spring contact and/or grip ring applied to the coaxial cable outer conductor outer diameter, the RF leakage eventually radiating out of a gap between the clamp ring and the outer conductor of the coaxial cable. RF leakage becomes especially significant as the operating frequency of signals transmitted along the coaxial cable increases towards higher microwave frequencies, which with shorter and shorter wavelengths are able to pass/leak through smaller and smaller gaps of the coaxial connector interconnection with the outer conductor of the coaxial cable.

Figure 1:
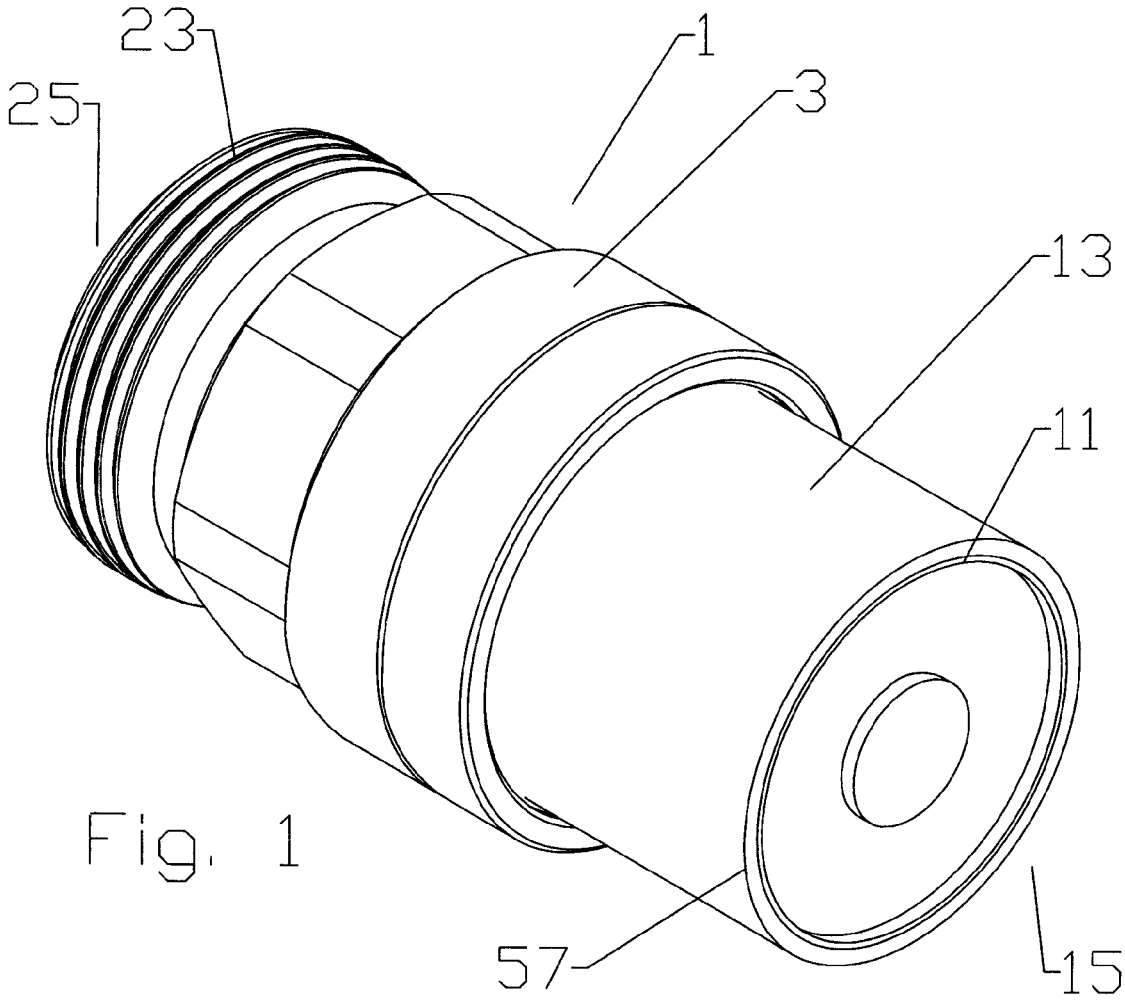
FIG. 1 is a schematic isometric rear view of a first exemplary embodiment of a coaxial connector.
Figure 2:
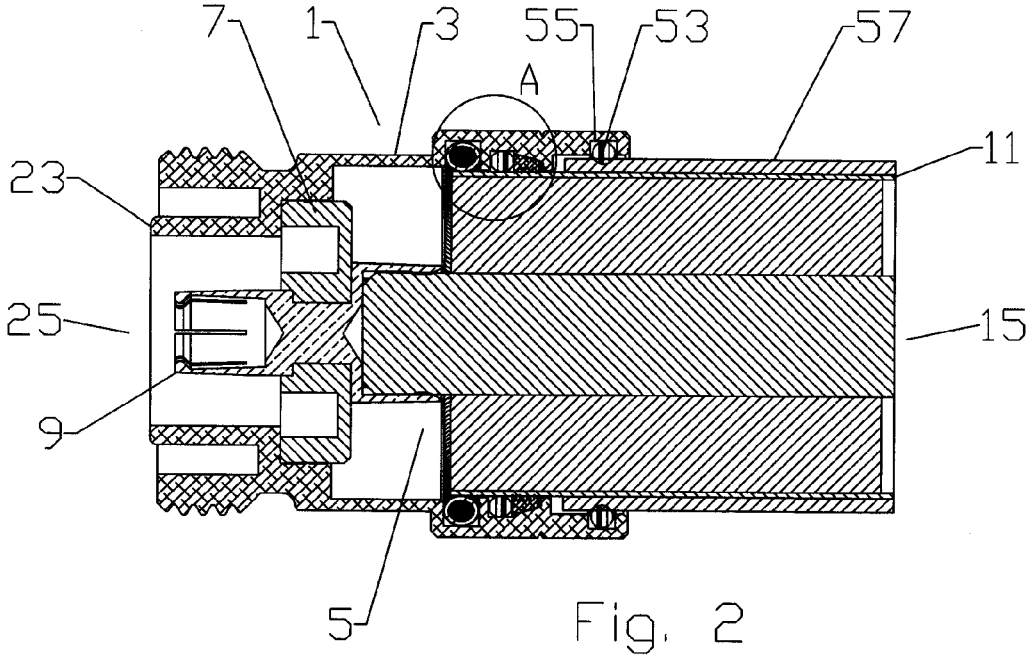
FIG. 2 is a schematic cross-section side view of the coaxial connector of FIG. 1, with a section of coaxial cable attached.
Figure 3:
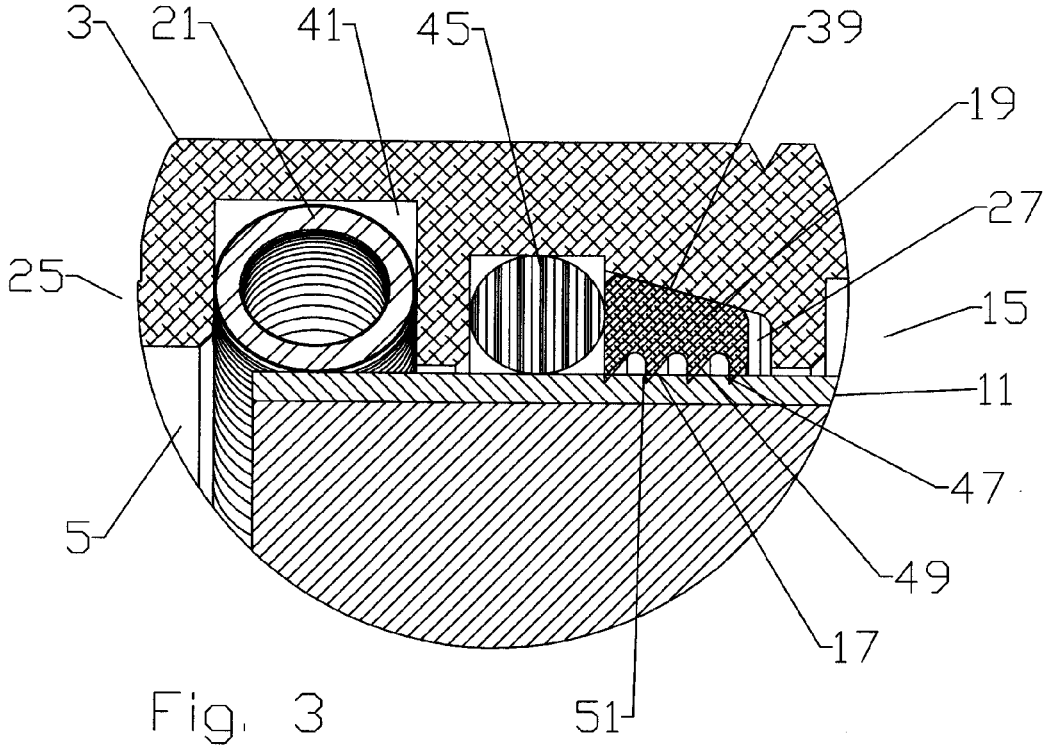
FIG. 3 is a close-up view of area A of FIG. 2.

As shown in a first exemplary embodiment in FIGS. 1-3, a coaxial connecter 1 has a connector body 3 with a connector body bore 5. An insulator 7 seated within the connector body bore 5 supports an inner contact 9 coaxial with the connector body bore 5. The coaxial connector 1 mechanically retains the outer conductor 11 of a coaxial cable 13 inserted into the cable end 15 of the connector body bore 5 via a grip surface 17 located on the inner diameter of a grip ring 19. A spring contact 21 seated within the connector body bore 5 makes circumferential contact with the outer conductor 11, proximate the end of the outer conductor 11, electrically coupling the outer conductor 11 across the connector body 3 to a connector interface 23 at the connector end 25.

The connector interface 23 may be any desired standard or proprietary interface.

One skilled in the art will appreciate that the cable end 15 and the connector end 25 are descriptors used herein to clarify longitudinal locations and contacting interrelationships between the various elements of the coaxial connector 1. In addition to the identified positions in relation to adjacent elements along the coaxial connector longitudinal axis, each individual element has a cable end side and a connector end side, i.e. the sides of the respective element that are facing the respective cable end 15 and the connector end 25 of the coaxial connector 1.

Figure 4:
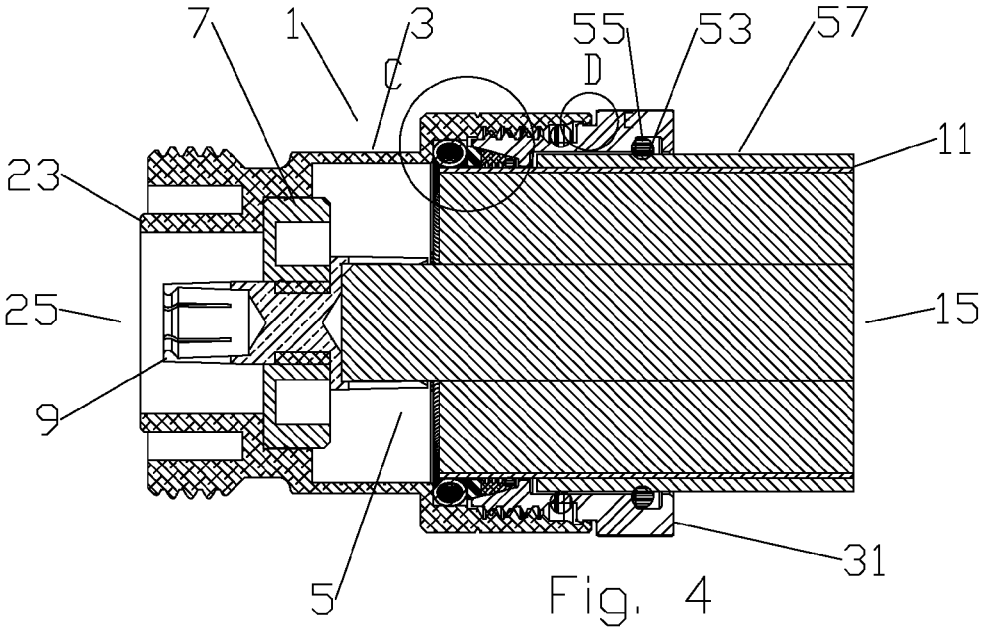
FIG. 4 is a schematic cross-section view of an alternative embodiment coaxial connector, with a section of coaxial cable attached.
Figure 5:
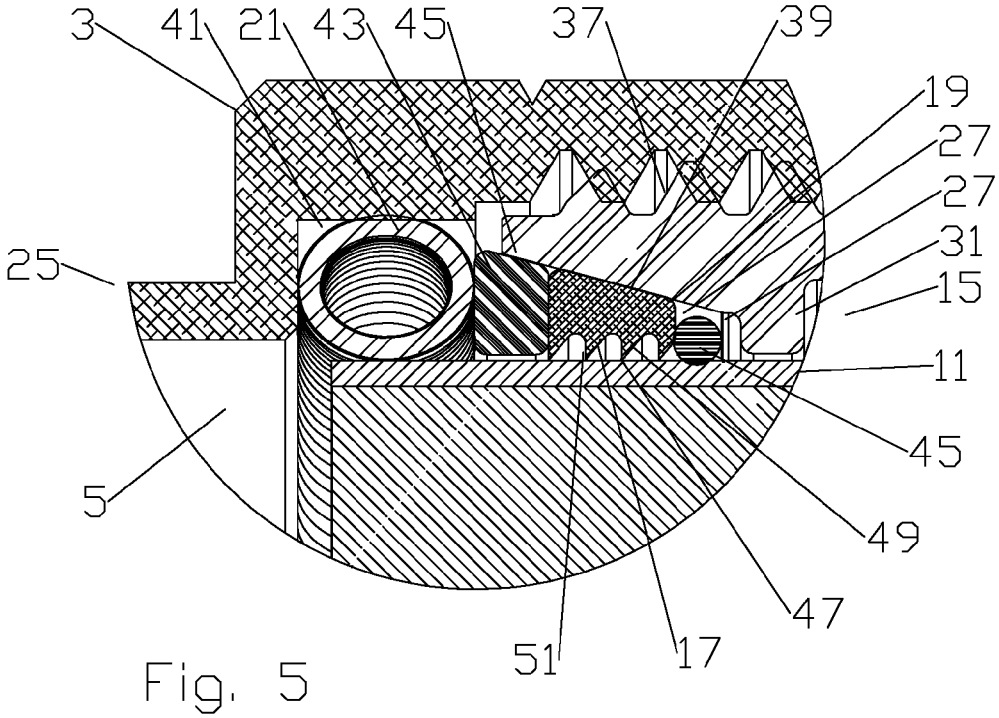
FIG. 5 is a close-up view of area C of FIG. 4.

The grip ring 19 may be retained within the connector body bore 5, for example seated within a grip ring groove 27. For ease of grip ring 19 installation (and further elements, if present, described herein below) and/or enhanced grip ring 19 to outer conductor 11 gripping characteristics, the grip ring groove 27 may be formed wherein the cable end grip ring groove sidewall and/or bottom are surfaces of a clamp nut 31 coupled to the connector body 3, for example as shown in FIGS. 4 and 5.

Figure 6:
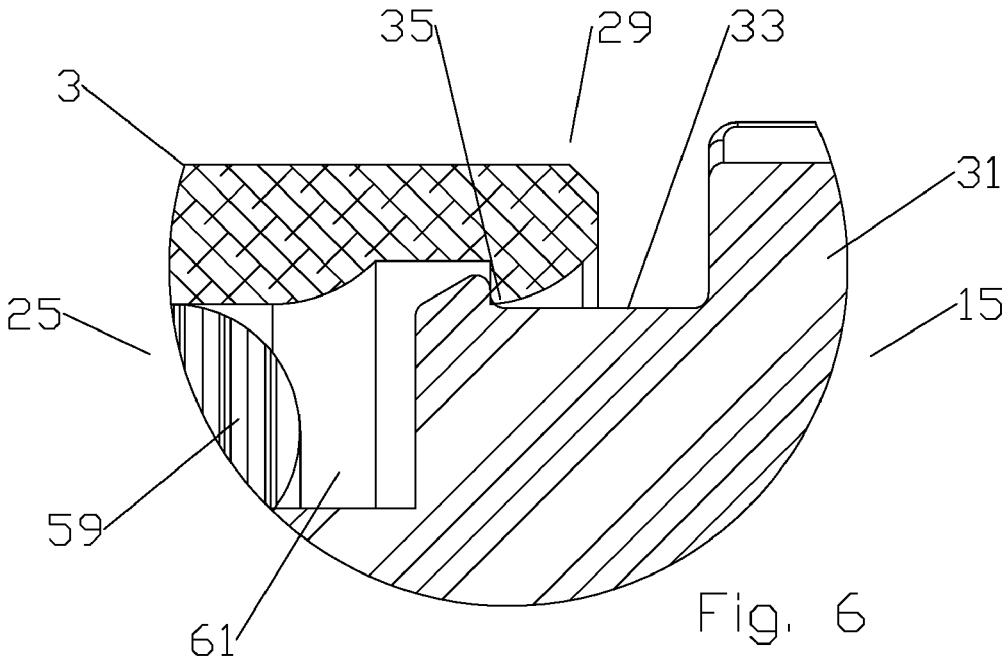
FIG. 6 is a close-up view of area D of FIG. 4.
Figure 7:
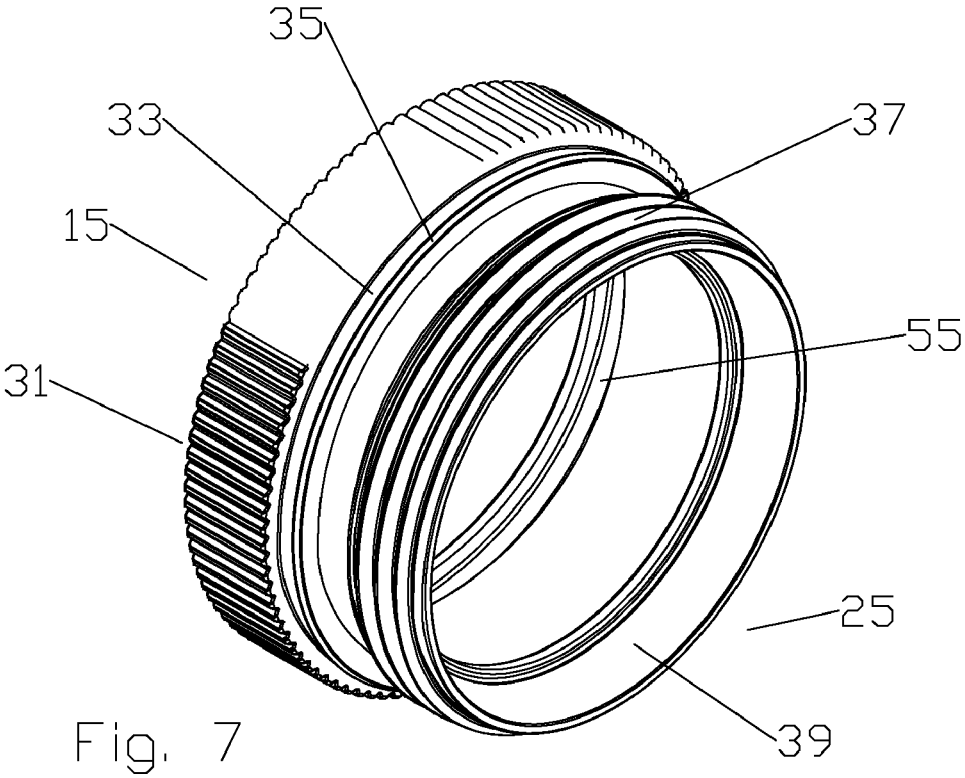
FIG. 7 is a schematic isometric view of the clamp ring of FIG. 4.

The clamp ring 31, if present, may be coupled to the connector body 3 by a retaining feature 29, such as an interlock between one or more annular snap groove(s) 33 in the outer diameter of the clamp ring and corresponding snap barb(s) 35 provided on an inner diameter of the connector body bore 5, as best shown for example in FIG. 6. Alternatively, the positions of the snap groove(s) 33 and the corresponding snap barb(s) 35 may be reversed.

Clamp ring threads 37 between the connector body bore 5 and an outer diameter of the clamp ring 31 may also be provided as an alternative to the retaining feature 29. To enable the coaxial connector 1 to be supplied as a ready-for-installation assembly, the clamp ring threads 37 may be combined with the snap groove 33 and snap 35 interconnection to provide an assembly that may be supplied with the clamp ring 31 already attached to the connector body 3, preventing disassembly and/or loss of the internal elements, as shown for example in FIGS. 4-7. Where the retaining feature 29 combines the clamp ring threads 37 with the snap groove 33 and snap barb 35, the longitudinal travel of the clamp ring 31 with respect to the connector body 3 via threading along the clamp ring threads 37 is limited by a width within the snap groove 33 across which the snap barb 35 may move before interfering with the snap groove 33 sidewalls.

Figure 8:
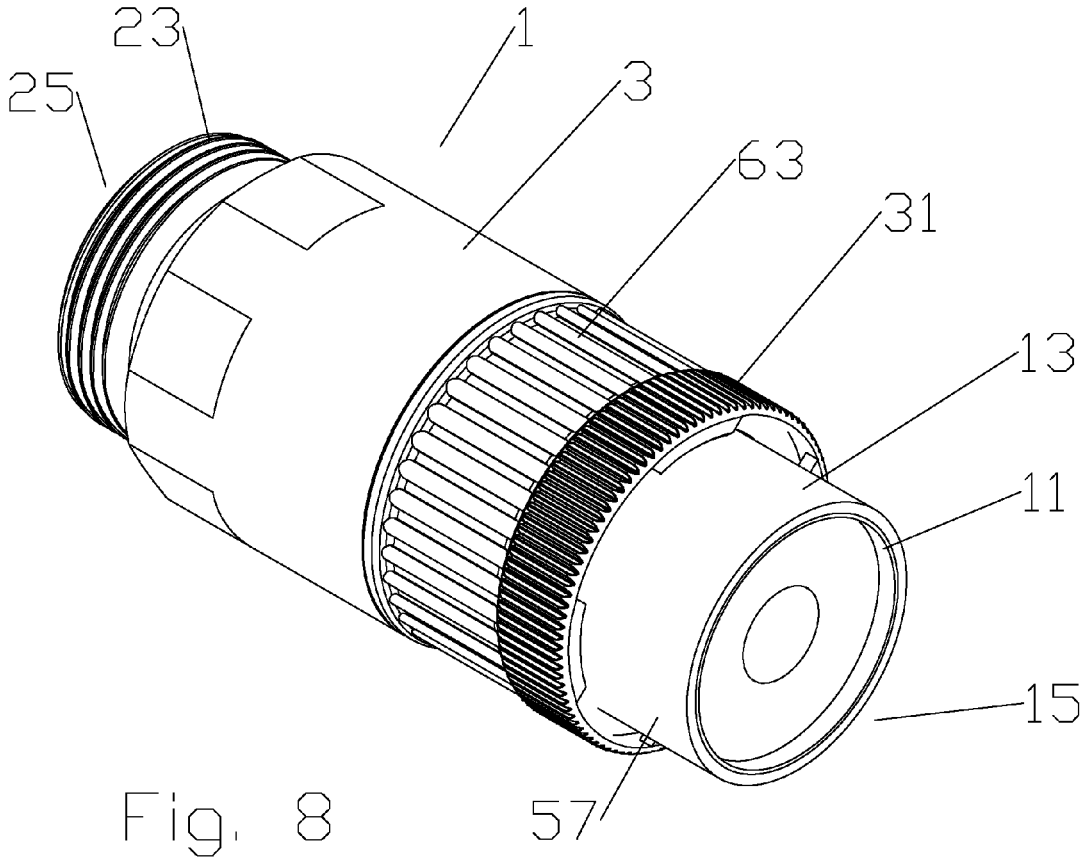
FIG. 8 is a schematic isometric view of another alternative embodiment of a coaxial connector.
Figure 9:
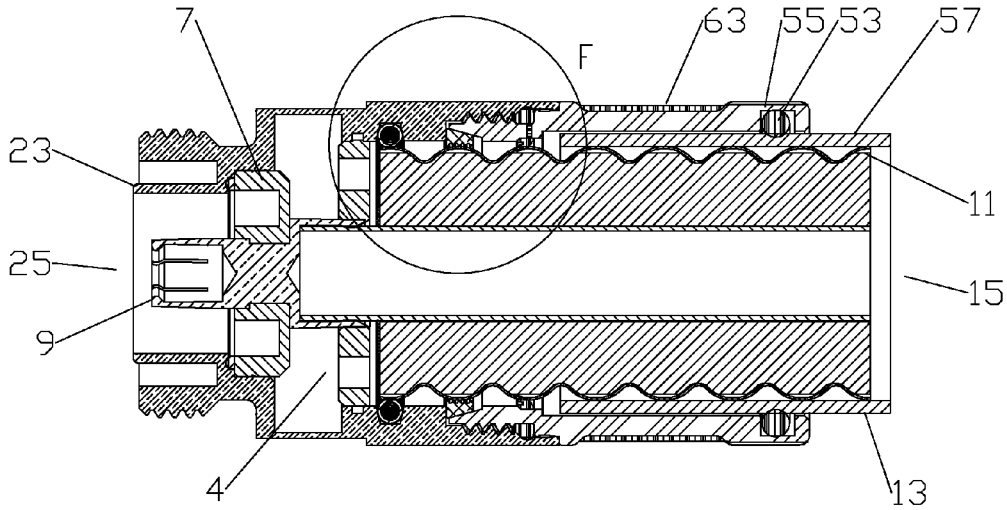
FIG. 9 is a schematic cross-section view of FIG. 8.
Figure 10:
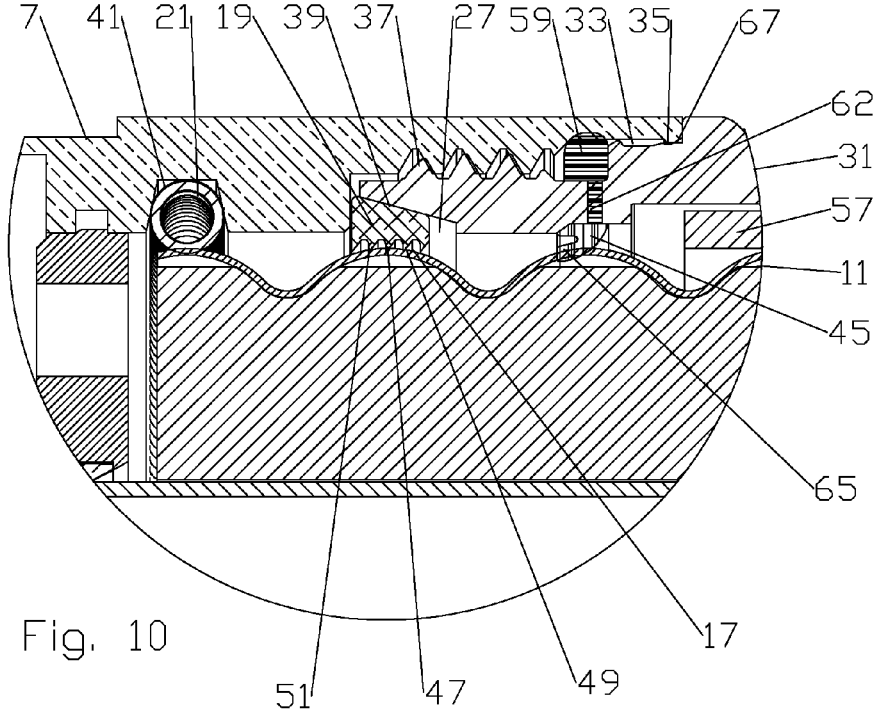
FIG. 10 is a close-up view of area F of FIG. 9.

In an alternative embodiment demonstrated in FIGS. 8-10, the retaining feature may also include an interference fit 67 between the connector body 3 and the clamp ring 31 positioned to engage during final threading together of the connector body 3 and the clamp ring 31. The interference fit 67 is operative to resist unthreading/loosening of the clamp ring 31 once threaded into the connector body 3.

Figure 11:
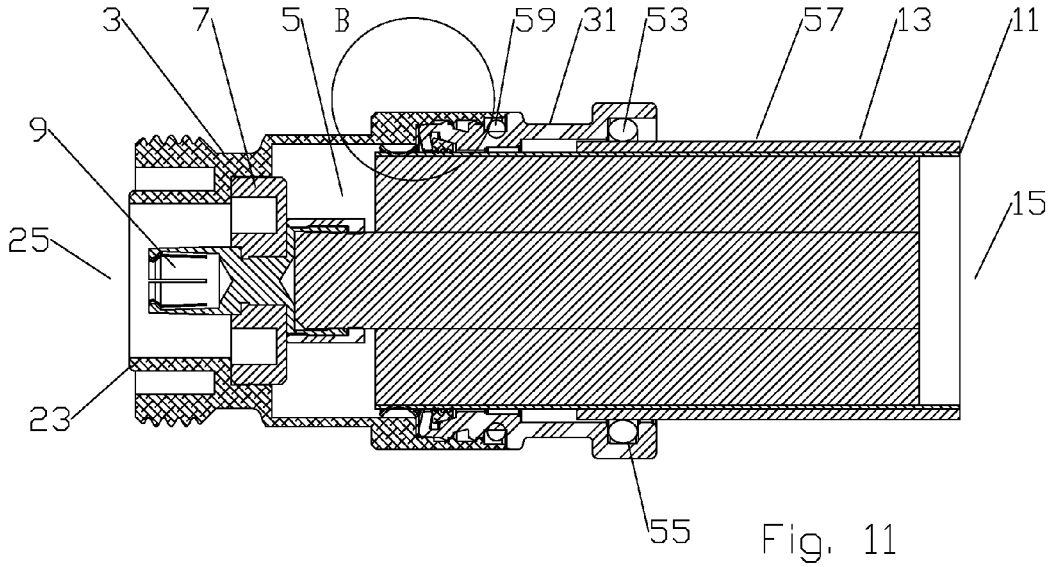
FIG. 11 is schematic cross-section view of another alternative embodiment of a coaxial connector.
Figure 12:
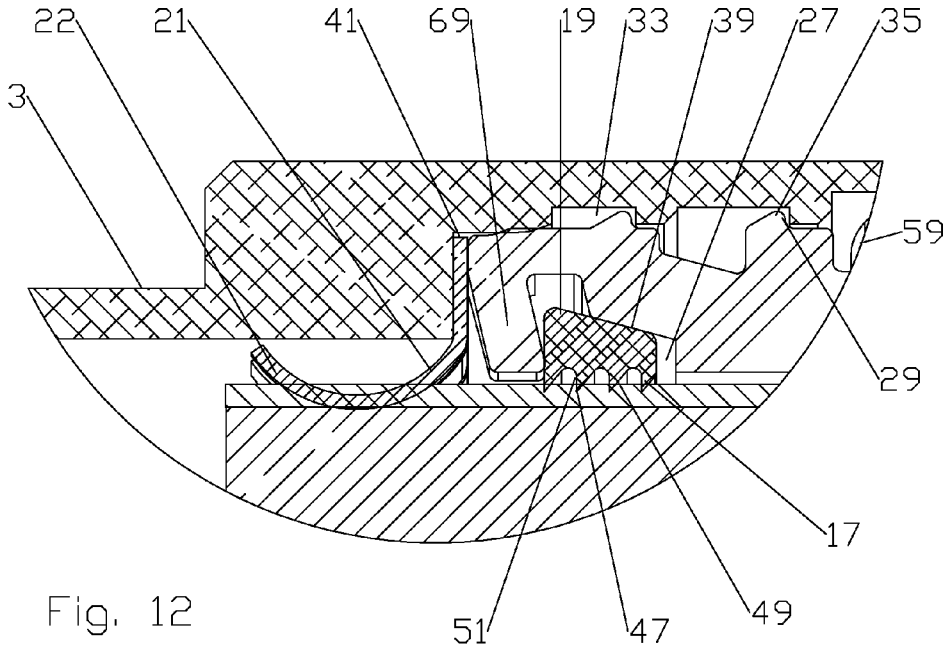
FIG. 12 is a close-up view of area B of FIG. 11.
Figure 13:
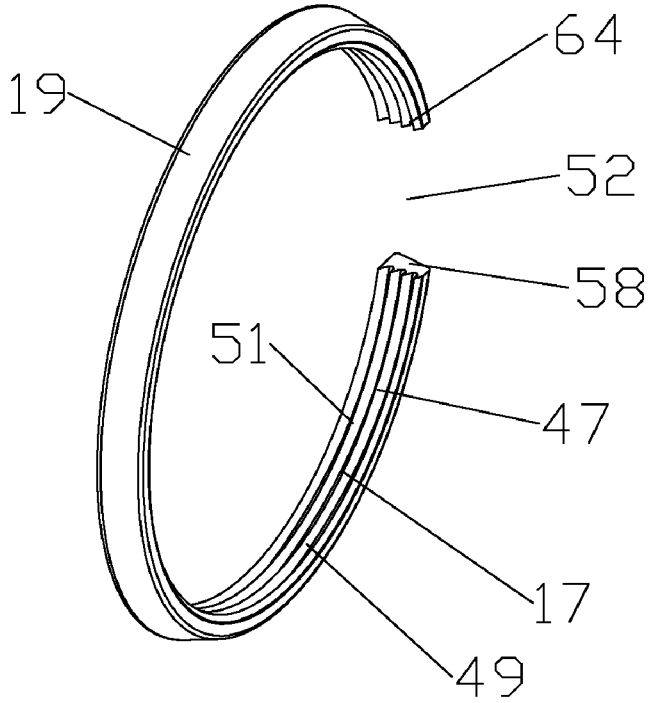
FIG. 13 is a schematic isometric view of a grip ring with a solid cross-section and annular barbs.

The spring contact 21 may be any conductive structure with a spring characteristic, such as a helical coil spring. Referring again to FIGS. 2 and 3, the spring contact 21 may be seated in a separate spring groove 41 of the connector body bore sidewall or alternatively seated on a connector end side of the grip ring groove 27, for example as shown in FIGS. 4 and 5. Where the spring contact 21 is in the grip ring groove 27, a spacer 43 may be applied between the spring contact 21 and the grip ring 19 and/or an outer conductor seal 45. The spacer 43 may be seated directly against the connector body 3 or alternatively configured to seat against the wedge surface 39. Alternatively, the spring contact 21 may be a stamped metal spring ring with a plurality of spring fingers, for example as shown in FIGS. 11 and 12, retained in electrical contact with the connector body 3, for example, by the clamp ring 31.

As best viewed in FIGS. 3, 5, 10, 12, 19 and 26, an annular wedge surface 39 within the grip ring groove 27 has a taper between a maximum diameter at a connector end side and a minimum diameter at a cable end side. An outer diameter of the grip ring 19 contacts the wedge surface 39 and is thereby driven radially inward by passage along the wedge surface 39 toward the cable end 15.

The contact between the outer diameter of the grip ring 19 and the wedge surface 39 may be along a corner of the grip ring 19 that may be rounded to promote smooth travel therealong, or alternatively the grip ring 19 may be formed with an extended contact area between the grip ring 19 and the wedge surface 39 by angling the outer diameter profile of the grip ring 19 to be parallel to the taper of the wedge surface 39.

Figure 14:
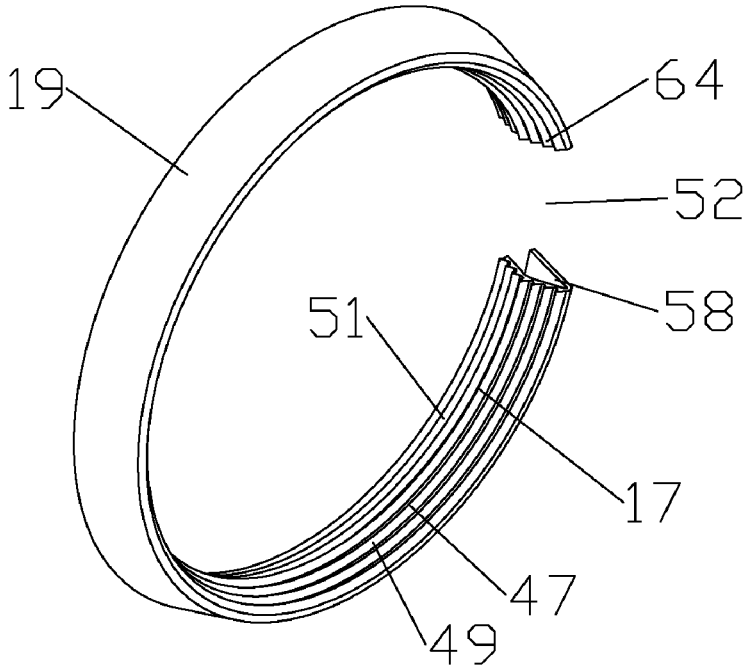
FIG. 14 is a schematic isometric view of a grip ring with a horizontal V cross-section.
Figure 15:
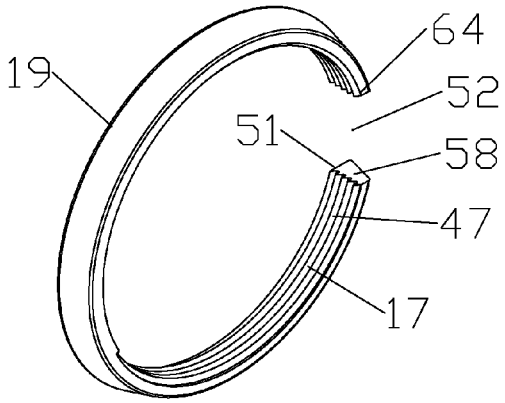
FIG. 15 is a schematic isometric view of a grip ring with a solid cross-section and helical barbs.
Figure 17:
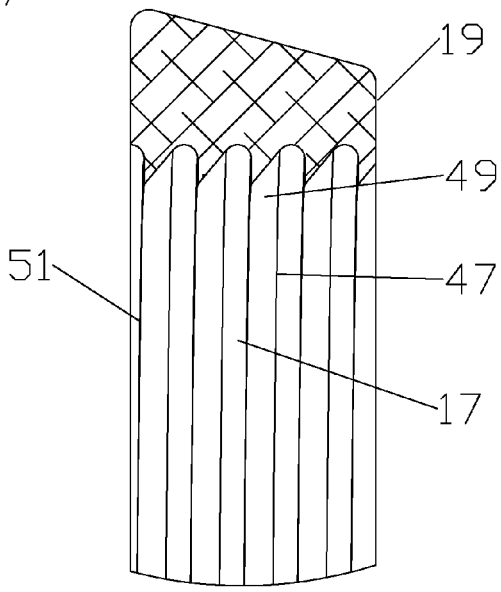
FIG. 17 is a close-up cross section view along line B-B of FIG. 16.
Figure 16:
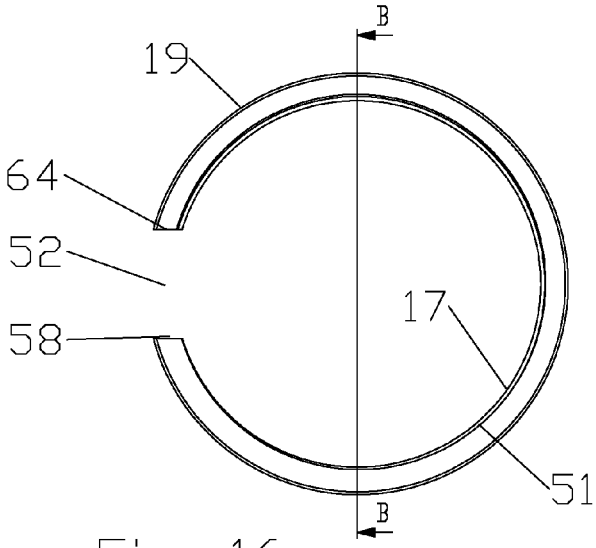
FIG. 16 is a schematic connector end side view of the grip ring of FIG. 15.

The grip ring 19 may be formed as a c-shaped ring, for example as shown in FIGS. 13 and 15-17, with a solid cross-section. Alternatively, the grip ring 19 may be formed with a horizontal V and/or U shaped cross-section as shown for example in FIG. 14. In this embodiment, the grip ring 19 has a spring property biasing the grip surface 17 into engagement with the outer diameter surface of the outer conductor 11, rather than only a direct mechanical linkage via the radial inward movement of the grip ring 19 according to the longitudinal position of the grip ring 19 with respect to the wedge surface 39.

The spreading/contracting variable diameter characteristic of the grip ring 19 as the wedge surface 39 is traversed axially and/or any manufacturer variances in the diameter of the coaxial cable outer conductor 11 are encountered requires a gap 52 along the circumference of the grip ring 19 (thus the c-shape of the grip ring 19). A width of the gap 52 may be selected in view of a differential between the maximum and minimum diameter the grip ring 19 is expected to provide.

Figure 18:
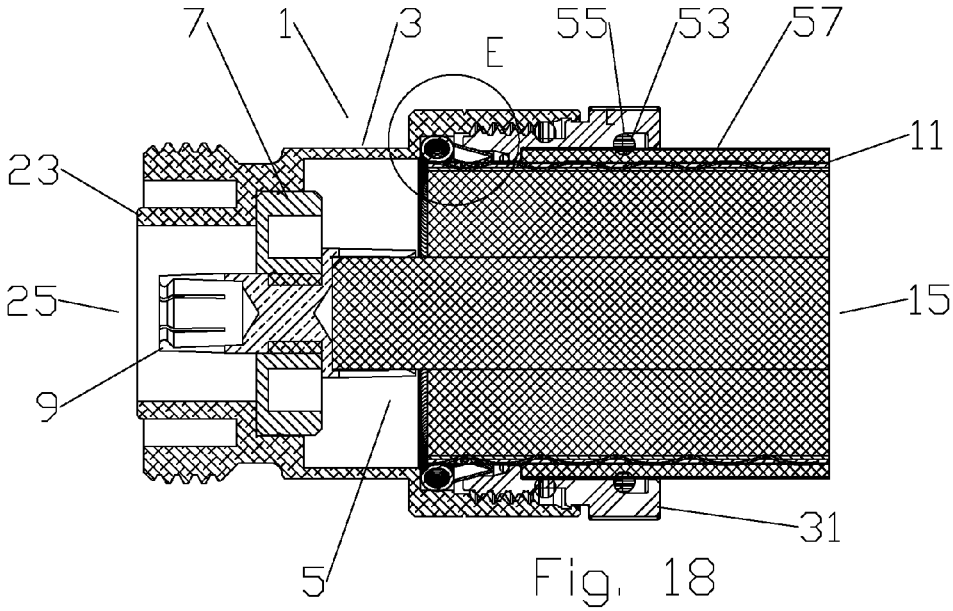
FIG. 18 is a schematic cross-section view of another alternative embodiment coaxial connector, with a section of coaxial cable attached.
Figure 19:
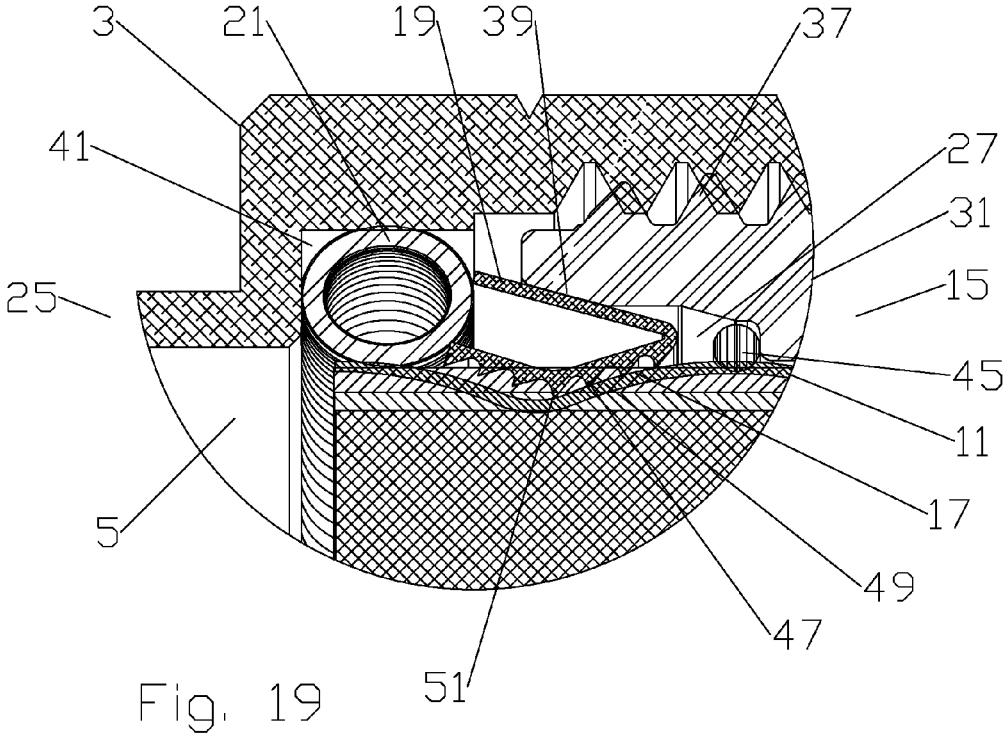
FIG. 19 is a close-up view of area E of FIG. 18.
Figure 20:
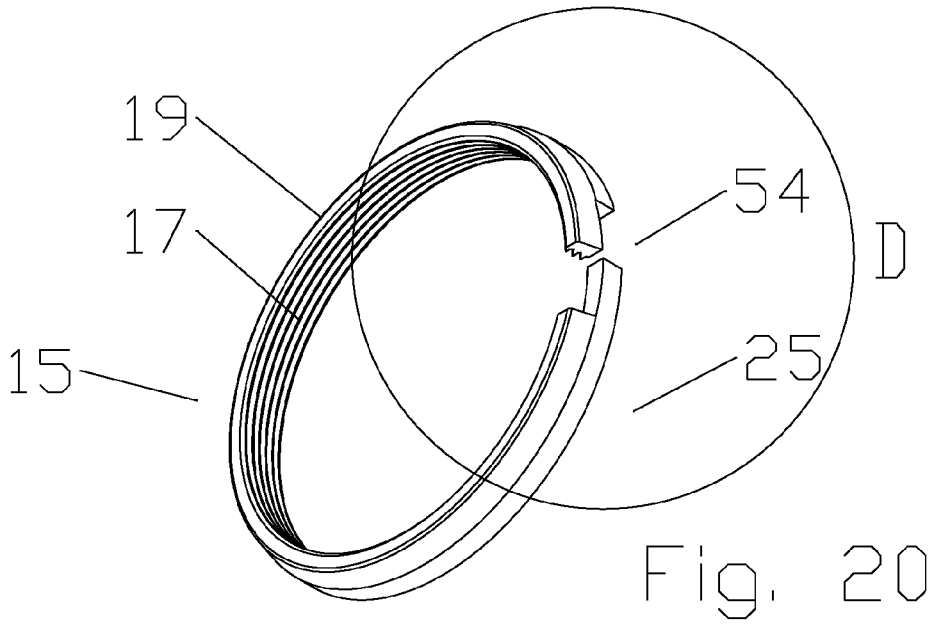
FIG. 20 is an isometric view of an alternative grip ring with an overlap slot arrangement.
Figure 21:
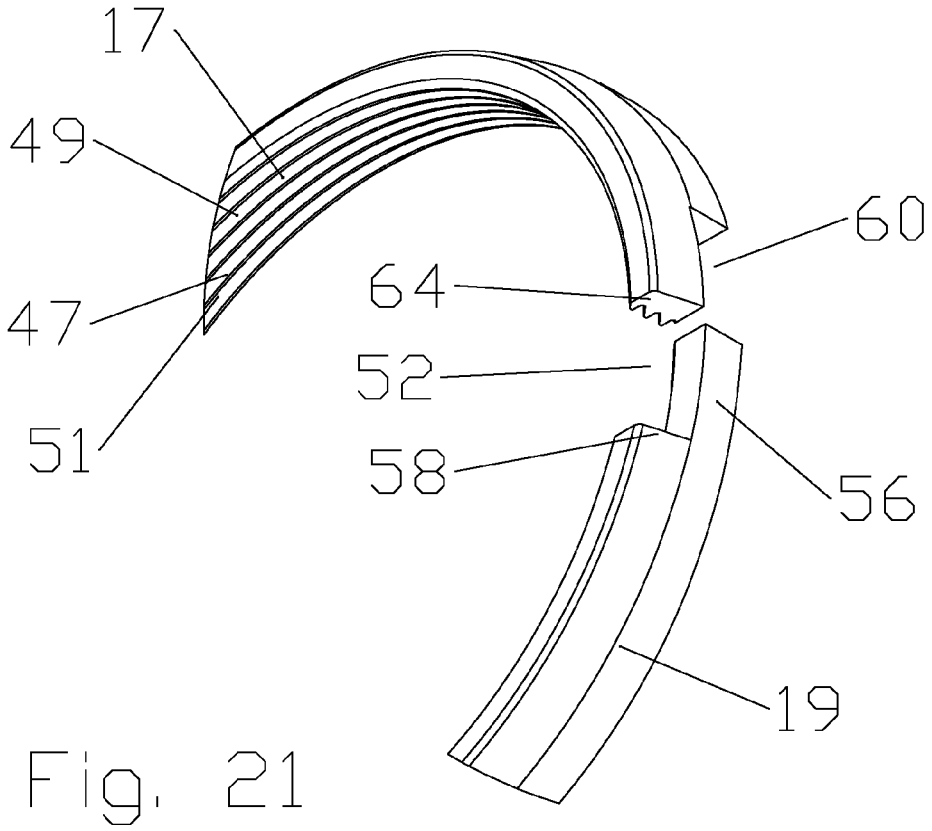
FIG. 21 is a close-up view area D of FIG. 20.
Figure 22:
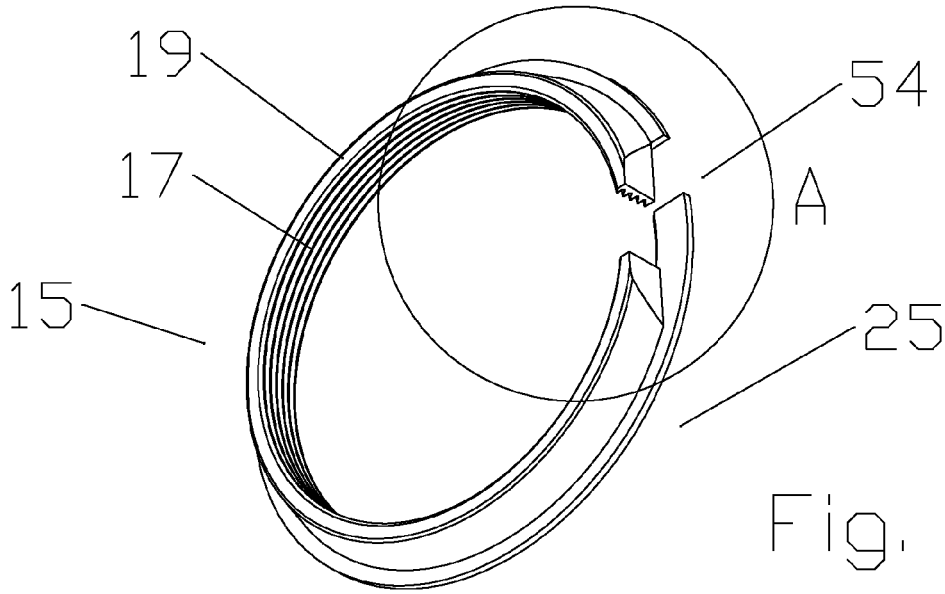
FIG. 22 is an isometric view of an alternative grip ring with an overlap slot arrangement and a flange edge.
Figure 23:
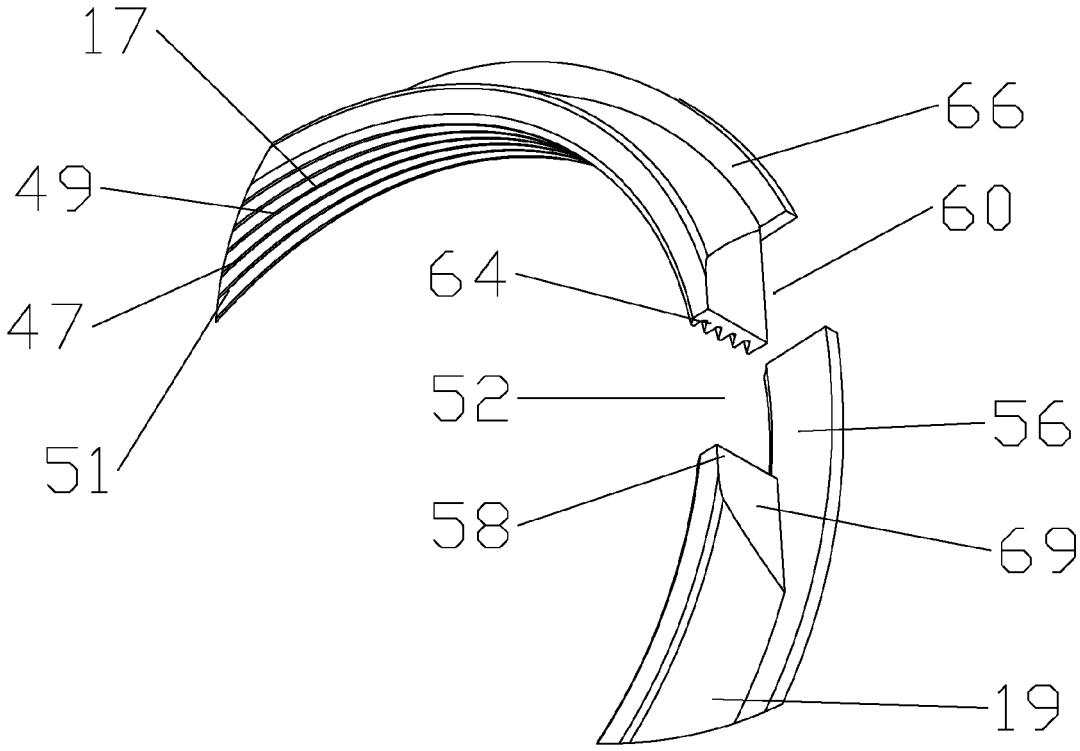
FIG. 23 is a close-up view of Area A of FIG. 22.
Figure 24:
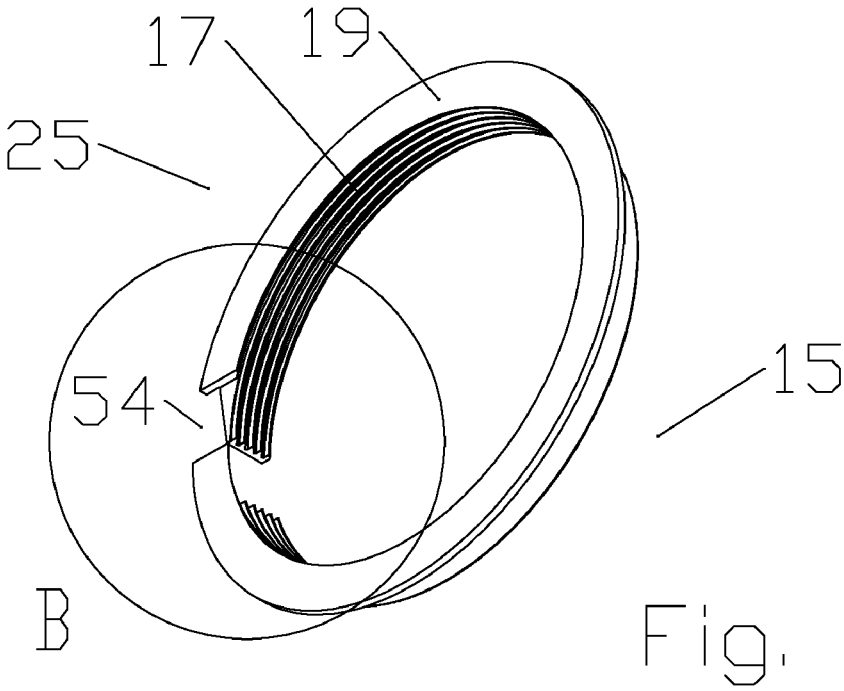
FIG. 24 is a back side isometric view of the grip ring of FIG. 22.
Figure 25:
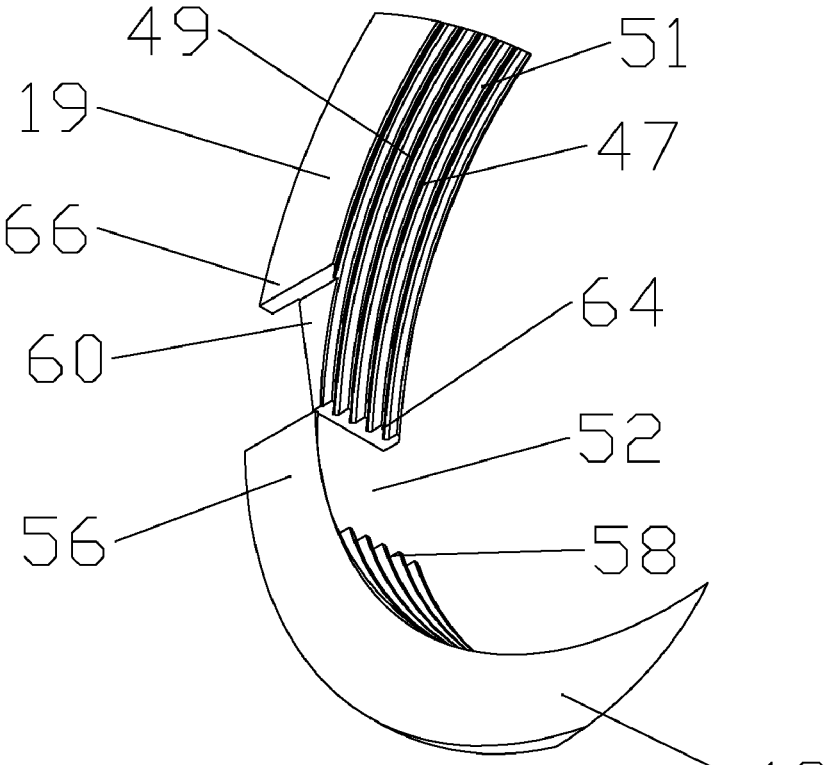
FIG. 25 is a close-up view of area B of FIG. 24.

The grip surface 17 of the grip ring 19 has a directional bias, engaging and gripping the outer diameter surface of the outer conductor 11 when in tension toward the cable end 15 while allowing the outer conductor 11 to slide past the grip surface 17 when moved toward the connector end 25. The grip surface 17 may be formed as a plurality of annular (FIGS. 13-14) or helical (FIGS. 15-17) grooves or barb(s) 47 provided with an angled face 49 extending from a groove bottom on the cable end 15 to a groove top on the connector end 25 of each groove and/or barb 47, the stop face 51 and the angled face 49 of adjacent grooves meeting at the groove top to form a point. A stop face 51 opposite the angled face 49 may be a vertical face with respect to the coaxial connector longitudinal axis and/or the stop face 51 may be angled toward the connector end 25 to present a barb point to grip and retain the outer conductor 11 when travel is attempted in the direction out of the connector body bore 5 toward the cable end 15. The grip surface 17 may be provided with a profile matching the characteristics of a particular solid outer conductor 11, for example a concave curved profile dimensioned to mate with a corrugation trough of an annular corrugated solid outer conductor coaxial cable 13, as shown for example in FIGS. 18 and 19. Similarly, the curved profile may be a convex configuration, dimensioned to cradle a corrugation peak.

The grip ring 19 has a range of longitudinal movement within the grip ring groove 27. As the grip ring 19 moves along the wedge surface 39 toward the connector end 25, for example as the leading edge of the outer conductor 11 is inserted into the connector body bore 5 from the cable end 15 and contacts the angled face(s) 49 of the grip surface 17, the grip ring 19 will either spread to allow the outer conductor to pass through, or will also begin to move longitudinally towards the connector end 25, within the grip ring groove 27. Because of the wedge surface taper, as the grip ring 19 moves towards the connector end 25, the depth of the grip ring groove 27 with respect to the grip ring 19 increases. Thereby, the grip ring 19 may be spread radially outward to enable the passage of the outer conductor 11 through the grip ring 19 and toward the connector end 25. Conversely, once spread, the bias of the grip ring 19 inward toward its relaxed state creates a gripping engagement between the grip surface 17 and the outer diameter surface of the outer conductor 11. If tension is applied between the connector body 3 and the coaxial cable 13 to pull the outer conductor 11 toward the cable end 15, the grip ring 19 is driven against the tapered wedge surface 39, progressively decreasing the depth of the grip ring groove 27, thereby driving the grip ring 19 radially inward and further increasing the gripping engagement as the grip surface 17 is driven into the outer diameter surface of the outer conductor 11. A cable end grip ring groove sidewall may be dimensioned to be at a position where the grip ring diameter relative to the outer conductor diameter is configured for the grip surface 17 to have securely engaged the outer conductor 11 but which is short of a grip ring radial inward movement capable of causing the outer conductor 11 to collapse radially inward beyond an acceptable level.

To minimize RF leakage through the gap 52 an overlap slot arrangement 54 may be applied wherein a shield portion 56 of a first end 58 of the grip ring 19 extends toward a corresponding slot portion 60 of a second end 64 of the grip ring 19, for example as shown in FIGS. 20-25. As the grip ring diameter is reduced by contact with the wedge surface 39, the shield portion 56 extends across the gap 52 and enters the slot portion 60, thereby closing the gap 52 without inhibiting the diameter variability of the grip ring 19. The closure of the gap 52 by the overlap slot arrangement 54 significantly reducing passage of RF leakage there through.

Figure 26:
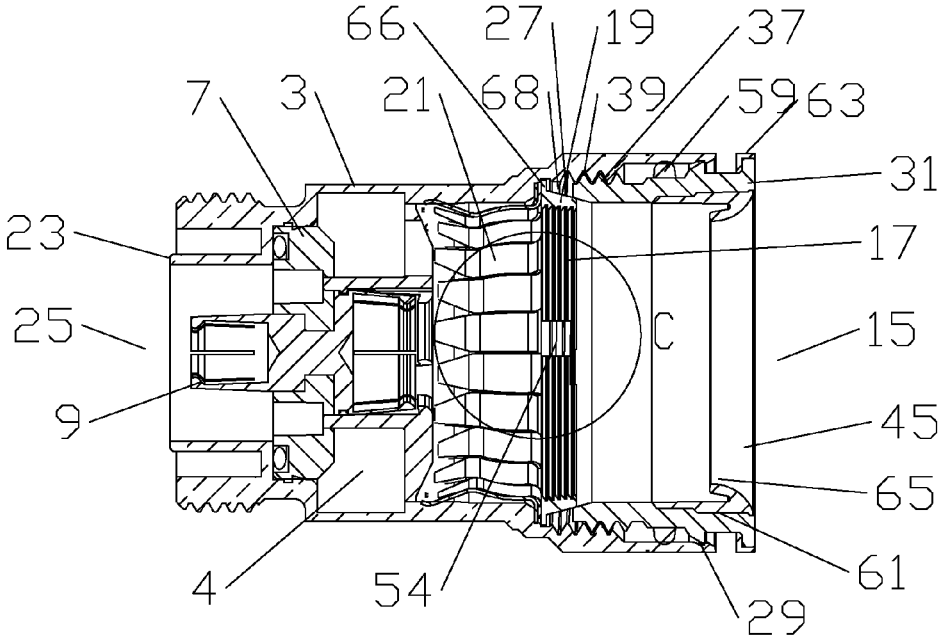
FIG. 26 is a schematic cross-section view of another alternative embodiment coaxial connector.
Figure 27:
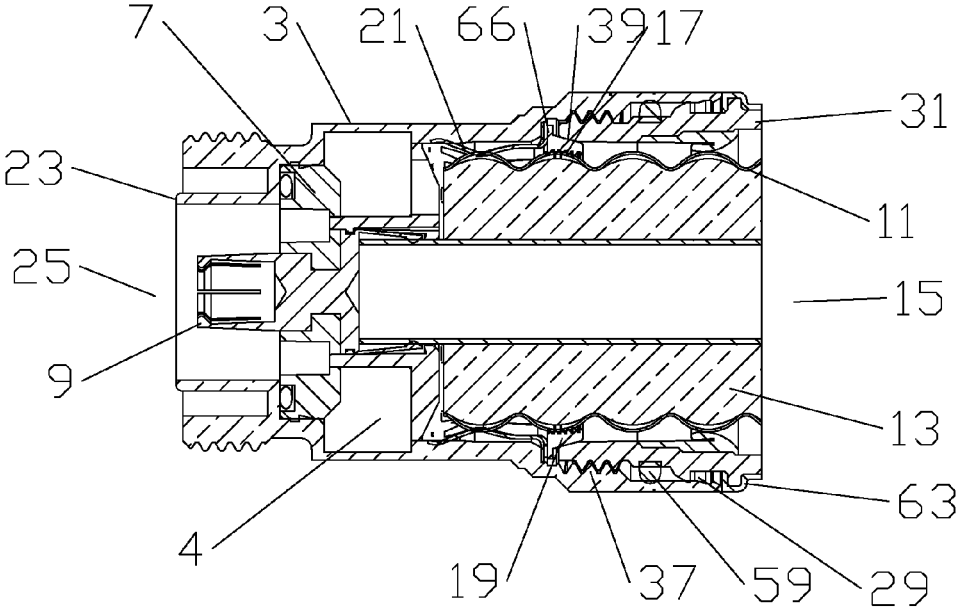
FIG. 27 is a view of the connector of FIG. 26, demonstrated with a coaxial cable attached.
Figure 28:
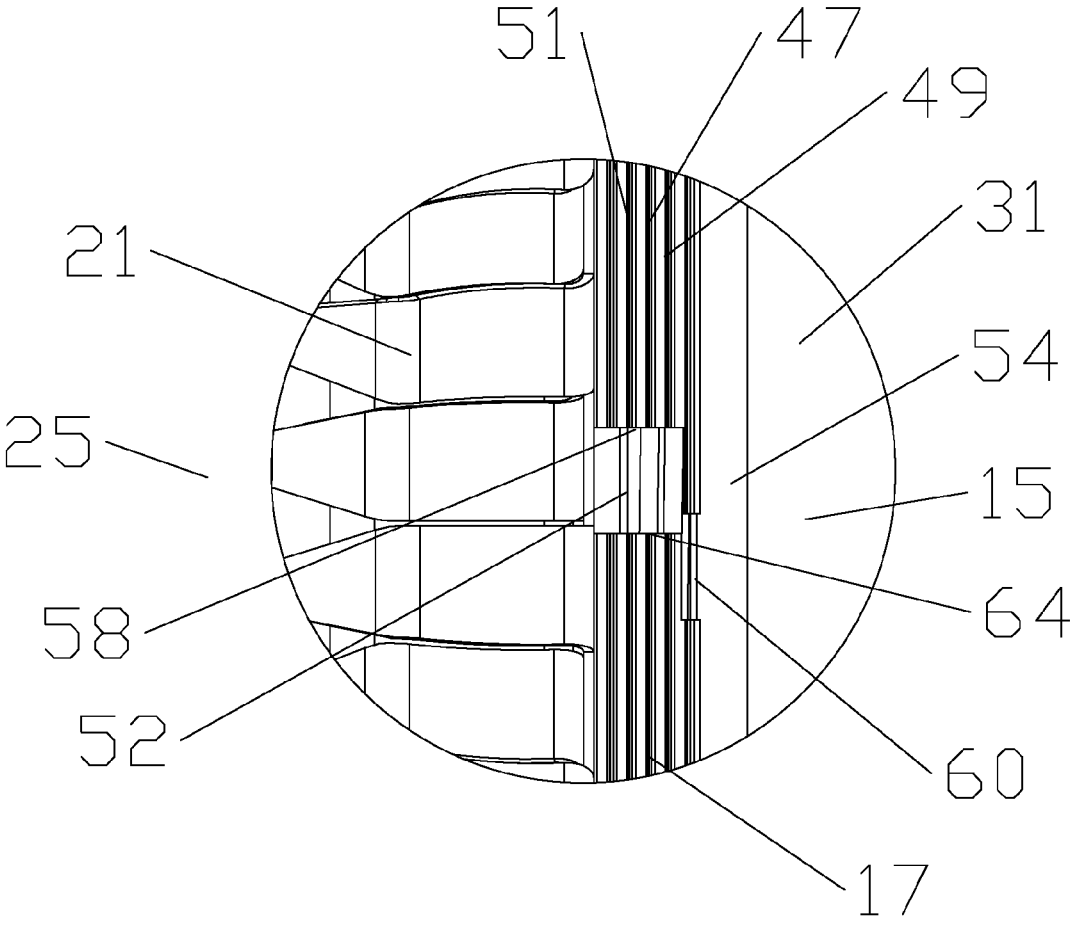
FIG. 28 is a close-up view of area C of FIG. 26.

A further reduction of RF leakage with respect to the grip ring 19 may be applied in the form of a flange edge 66 proximate the connector end of the grip ring 19, for example as shown in FIGS. 22-25. The flange edge 66, if present, extends radially outward around the circumference of the grip ring 19, including the shield portion 56. The grip ring groove 27 may be formed with a flange edge step 80 into which the flange edge 66 keys, or alternatively the grip ring groove 27 may be formed including a portion between the connector body 3 and the connector end of the clamp ring 31 forming the flange edge step, for example as shown in FIGS. 26 and 27. The flange edge 66 may also provide an additional grip ring locating functionality, the flange edge 66 providing additional retention of the grip ring 19 within the grip ring groove 27, prior to interconnection of the coaxial connector 1 and the end of the coaxial cable 13.

The grip ring 19 is preferably formed from a material, such as stainless steel or beryllium copper alloy, with a hardness characteristic greater than the material of the outer conductor 11 to enable the grip surface 17 to securely engage and grip the outer diameter of the outer conductor 11. For ease of manufacture, the gap 52 may be provided larger than the extension of the shield portion 56 into the gap 52 during a steady state of the grip ring 19, enabling manufacture of the grip ring 19 with overlap slot arrangement 54 via conventional metal machining techniques. To avoid generating sharp edges on the first and second ends of the grip ring 19 that may bind, catch upon and/or scrape the wedge surface, a chamfer 69 may be applied to the first end 58 and the second end 64, for example as shown in FIGS. 22-25.

During cable assembly on embodiments with a clamp ring 31 and a retaining feature 29 including the clamp ring threads 37, the limited longitudinal movement obtained by threading the clamp ring 31 into the connector body 3 is operative to drive the wedge surface 39 against the grip ring 19 to move the grip ring 19 radially inward into secure gripping engagement with the outer conductor 11, without requiring the application of tension between the connector body 3 and the coaxial cable 13. Further, in embodiments where the spring contact 21 is also present in the grip ring groove 27, the threading of the clamp ring 31 into the connector body bore 5 may be configured to apply directly and/or via a spacer 43, if present, pressure on the spring contact 21 whereby the spring contact 21 deforms radially inward toward the outer conductor 11, increasing the contact pressure between the spring contact 21 and the outer conductor 11, thereby improving the electrical coupling there between.

Returning to FIGS. 26 and 27, a jacket seal 53 and/or outer conductor seal 45 may be provided in a jacket groove 55 proximate the cable end 15 of the coaxial connector 1. As shown in FIG. 27, where the seal is against the outer conductor, the outer conductor seal 45 is dimensioned to seal between the connector body bore 5 or clamp ring 31, if present, and the jacket 57. If a clamp ring 31 is present, a further clamp ring seal 59 may be provided to seal between the clamp ring 31 and the connector body 3.

One skilled in the art will appreciate the significant manufacturing and installation benefits of the present invention. During manufacturing, a complete coaxial connector 1 assembly ready for installation is prepared with a minimal total number of required elements. If a clamp ring 31 is included in the configuration, the installation of the spring contact 21, spacer 43, grip ring 19 and/or outer conductor seal 45 is simplified by the improved access to the grip ring groove 27, which may then be easily closed by snapping/threading the clamp ring 31 in place after the desired sub elements have been seated in the open end(s) of the connector body bore 5 and/or clamp ring 31. Further, the various environmental seals (outer conductor seal 45, jacket seal 53 and or clamp ring seal 59) may be each overmolded upon the respective groove(s) to provide a single assembly with integral environmental seals. Hole(s) 62 may be formed from the outer diameter to the inner diameter of the clamp ring 31, enabling the outer conductor seal 45 and clamp ring seal 59 to be overmolded as a unitary inter-supporting gasket, best shown in FIG. 10. The additional retention of the outer conductor seal 45 provided by overmolding through the hole(s) 62 also enables an outer conductor seal 45 profile with a wiper extension 65. The wiper extension 65 enables the outer conductor seal 45 to more securely seal against both smooth and corrugated outer conductor coaxial cable(s) 13. A further overmolding may be applied in the form of a clamp ring grip 63, for example as shown in FIGS. 8 and 9, on an outer diameter of the clamp ring 31 for improved installer grip during hand threading of the clamp ring 31 into the connector body 3.

To install the coaxial connector 1 upon a coaxial cable 13, the coaxial cable end is stripped back to expose desired lengths of the conductor(s) and the stripped coaxial cable end inserted into the cable end 15 of the connector body bore 5 until bottomed. If present, the clamp ring 31, if including clamp ring threads 37, is then threaded toward the connector body 3 and a test tension between the connector body 3 and the coaxial cable 1 applied to verify secure engagement between the grip ring 19 and the outer conductor 11.

Coaxial connector 1 embodiments with a threaded clamp ring 31 may be uninstalled from the coaxial cable 13 for interconnection inspection and/or reuse by unthreading the clamp ring 31 away from the connector body 3, enabling the grip ring 13 to move outward and away from engagement with the outer conductor 11 as the wedge surface 39 shifts toward the cable end 15 with the clamp ring 31. When the grip ring 13 has disengaged, the coaxial cable 13 may be withdrawn from the connector body bore 5.

The prior manual cable end flaring operations and any required disassembly/reassembly of the various connector elements around the coaxial cable end during installation have been eliminated.

Table of Parts

| | |
|---|---|
| 1 | coaxial connector |
| 3 | connector body |
| 5 | connector body bore |
| 7 | insulator |
| 9 | inner contact |
| 11 | outer conductor |
| 13 | coaxial cable |
| 15 | cable end |
| 17 | grip surface |
| 19 | grip ring |
| 21 | spring contact |
| 22 | spring finger |
| 23 | connector interface |
| 25 | connector end |
| 27 | grip ring groove |
| 29 | retaining feature |
| 31 | clamp ring |
| 33 | snap groove |
| 35 | snap barb |
| 37 | clamp ring threads |
| 39 | wedge surface |
| 41 | spring groove |
| 43 | spacer |
| 45 | outer conductor seal |
| 47 | barb |
| 49 | angled face |
| 51 | stop face |
| 52 | gap |
| 53 | jacket seal |
| 54 | overlap slot arrangement |
| 55 | jacket groove |
| 56 | shield portion |
| 57 | jacket |
| 58 | first end |
| 59 | clamp ring seal |
| 60 | slot portion |
| 62 | hole |
| 63 | clamp ring grip |
| 64 | second end |
| 65 | wiper extension |
| 66 | flange edge |
| 67 | interference fit |
| 68 | flange edge step |
| 69 | chamfer |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A grip ring for a coaxial connector coupling with a coaxial cable with a solid outer conductor, the grip ring comprising:

a c-shaped ring provided with a gap between a first end and a second end;

a shield portion extending from the first end and a slot portion dimensioned to receive the shield portion provided in the second end;

the shield portion keying with the slot portion as a diameter of the grip ring is reduced;

an inner diameter of the grip ring provided with a grip surface; and an outer diameter surface of the ring is provided with a taper between a maximum diameter proximate the connector end and a minimum diameter proximate the cable end.

2. The grip ring of claim 1, wherein the grip surface is dimensioned to receive the outer conductor from the cable end therethrough and couple with an outer diameter of the outer conductor.

3. The grip ring of claim 1, wherein the slot portion is provided with a depth from the second end greater than or equal to an extension of the shield portion from the first end.

4. The grip ring of claim 1, further including a chamfer along the outer diameter at the first and second ends.

5. The grip ring of claim 1, wherein a width of the gap is proportional to a differential between a predetermined maximum and minimum diameter of the grip ring.

6. A grip ring for a coaxial connector coupling with a coaxial cable with a solid outer conductor, the grip ring comprising:

a c-shaped ring provided with a gap between a first end and a second end;

a shield portion extending from the first end and a slot portion dimensioned to receive the shield portion provided in the second end;

the shield portion keying with the slot portion as a diameter of the grip ring is reduced;

an inner diameter of the grip ring provided with a grip surface; and a flanged edge proximate a connector end of the ring outer diameter; the flanged edge extending radially outward.

7. The grip ring of claim 6, wherein the flanged edge is provided on the shield portion.

8. The grip ring of claim 6, wherein the flanged edge has a width equal to a width of the shield portion.

9. A grip ring for a coaxial connector coupling with a coaxial cable with a solid outer conductor, the grip ring comprising:

a c-shaped ring provided with a gap between a first end and a second end;

a shield portion extending from the first end and a slot portion dimensioned to receive the shield portion provided in the second end;

the shield portion keying with the slot portion as a diameter of the grip ring is reduced;

an inner diameter of the grip ring provided with a grip surface; and wherein the ring has a solid cross section.

10. A grip ring for a coaxial connector coupling with a coaxial cable with a solid outer conductor, the grip ring comprising:

a c-shaped ring provided with a gap between a first end and a second end;

a shield portion extending from the first end and a slot portion dimensioned to receive the shield portion provided in the second end;

the shield portion keying with the slot portion as a diameter of the grip ring is reduced;

an inner diameter of the grip ring provided with a grip surface; and wherein the grip surface is a plurality of grooves; the grooves provided with a vertical stop face at a cable end side and an angled face extending from a groove bottom to a groove top at a connector end side.

11. The grip ring of claim 10, wherein the grooves are annular.

12. The grip ring of claim 10, wherein the grooves are helical.

13. A grip for a coaxial connector coupling with a coaxial cable with a solid outer conductor, the grip ring comprising:

a c-shaped ring provided with a gap between a first end and a second end;

a shield portion extending from the first end and a slot portion dimensioned to receive the shield portion provided in the second end;

the shield portion keying with the slot portion as a diameter of the grip ring is reduced;

an inner diameter of the grip ring provided with a grip surface; and wherein the grip surface is a plurality of grooves; the grooves provided with a stop face sidewall at a cable end side and an angled face at a connector end side, both the stop face and the angled face angled toward a connector end side, the stop face and the angled face of adjacent grooves meeting at a top of each groove.

14. The grip ring of claim 13, wherein the grooves are annular.

15. The grip ring of claim 13, wherein the grooves are helical.

16. The grip ring of claim 13, wherein the stop face sidewall is normal to a longitudinal axis of the ring.

17. A grip ring for a coaxial connector coupling with a coaxial cable with a solid outer conductor, the grip ring comprising:

a c-shaped ring provided with a gap between a first end and a second end;

a chamfer provided along a ring outer diameter at the first and second ends;

a shield portion extending from the first end and a slot portion dimensioned to receive the shield portion provided in the second end;

the slot portion being provided with a depth from the second end greater than or equal to an extension of the shield portion from the first end;

the shield portion keying with the slot portion as a diameter of the grip ring is reduced;

an inner diameter of the grip ring provided with a grip surface;

the grip surface being dimensioned to receive the outer conductor from the cable end therethrough and couple with an outer diameter of the outer conductor;

an outer diameter surface of the ring being provided with a taper between a maximum diameter proximate the connector end and a minimum diameter proximate the cable end;

a flanged edge proximate a connector end of the ring outer diameter; the flanged edge extending radially outward.

18. The grip ring of claim 17, wherein the grip surface is a plurality of annular grooves.

19. The grip ring of claim 17, wherein the grip surface is a helical groove.

* * * * *